US005549228A

United States Patent [19]

Brown

[11] Patent Number: 5,549,228

[45] Date of Patent: Aug. 27, 1996

[54] ATTACHMENT SYSTEM FOR FLUENT PRODUCT DISPENSERS

[75] Inventor: Daniel P. Brown, Palos Park, Ill.

[73] Assignee: Insta-Foam Products, Inc., Joliet, Ill.

[21] Appl. No.: 514,065

[22] Filed: Aug. 11, 1995

[51] Int. Cl.[6] ..... B65D 5/72

[52] U.S. Cl. ..... 222/570; 222/402.1; 285/401

[58] Field of Search ..... 222/570, 402.1; 239/390, 397; 285/401, 376

[56] References Cited

U.S. PATENT DOCUMENTS 2,981,450 4/1961 Anderson ..... 222/570
3,182,866 5/1965 Rowe ..... 222/570
4,231,494 11/1980 Greenwood ..... 285/401

*Primary Examiner*—Gregory L. Huson
*Attorney, Agent, or Firm*—Lockwood, Alex, FitzGibbon & Cummings

[57] ABSTRACT

A twist lock system for a dispensing container which includes a locking ring for a pressurized container, a dispensing gun having a combination twist lock and valve actuating system including two pairs of radially and circumferentially spaced locking lugs cooperating with slots and the locking ring, an axially movable valve stem positioned in a body secured to the container end and a valve capturing and actuating surface formed on the dispenser gun, with the components constructed and arranged so that the valve cannot be actuated unless the container and gun are properly positioned.

12 Claims, 5 Drawing Sheets

FIG. 2A
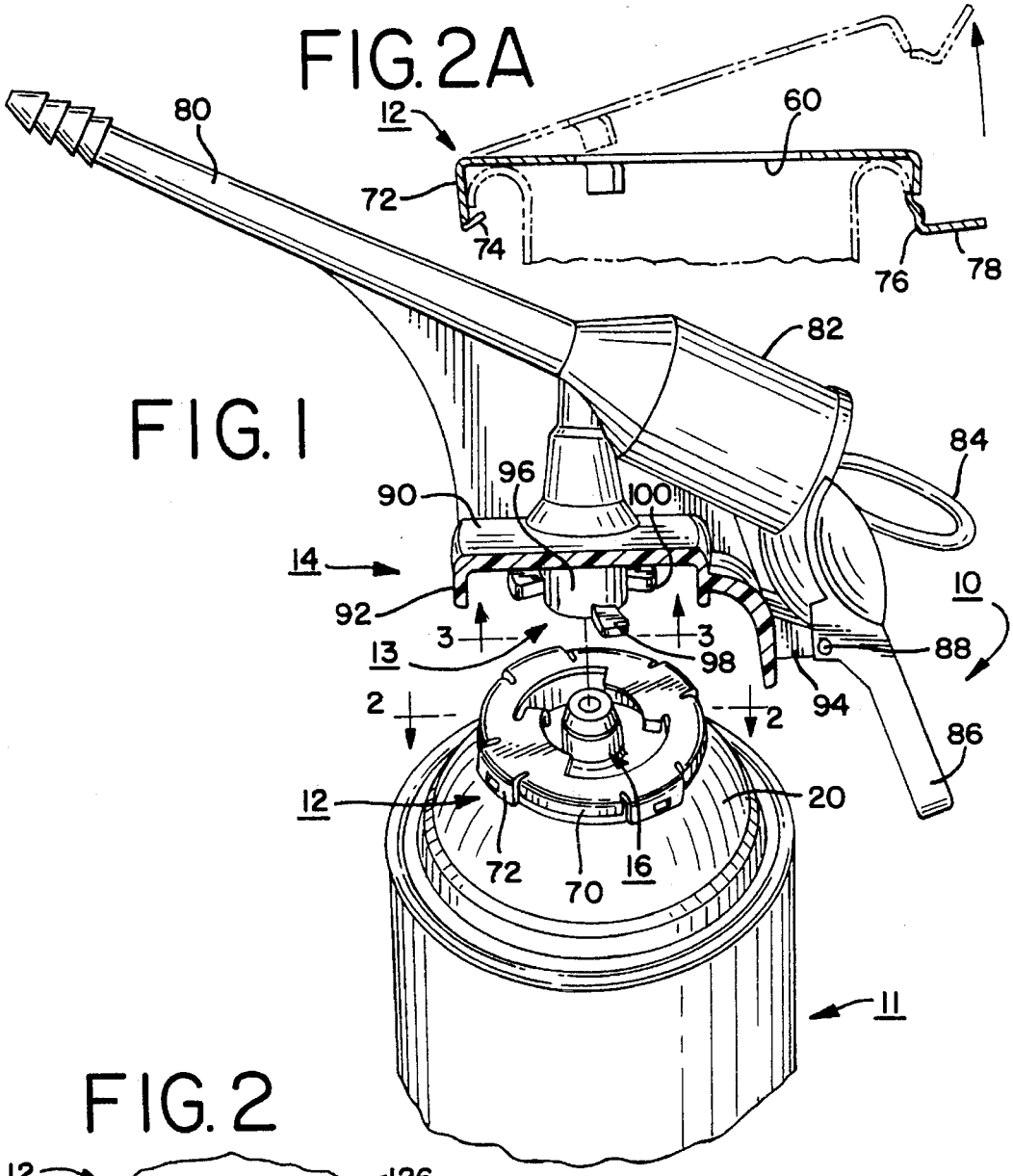
FIG. 1
FIG. 2
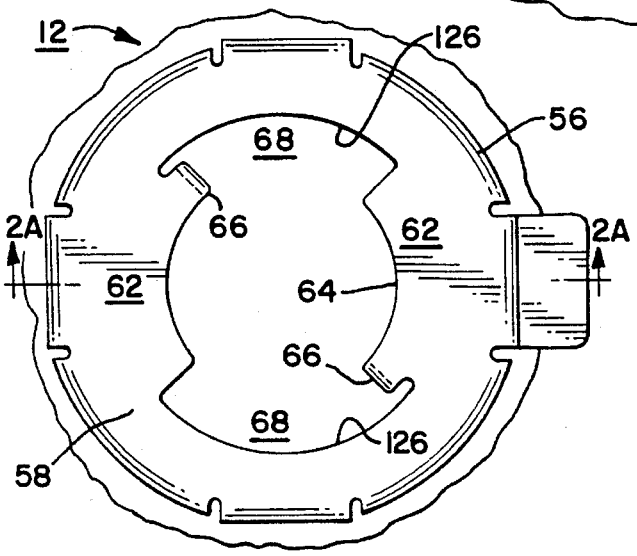
FIG. 3
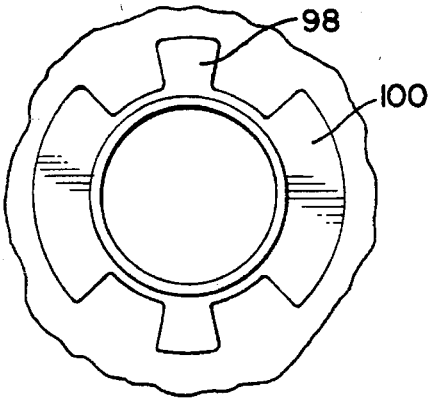

FIG. 7
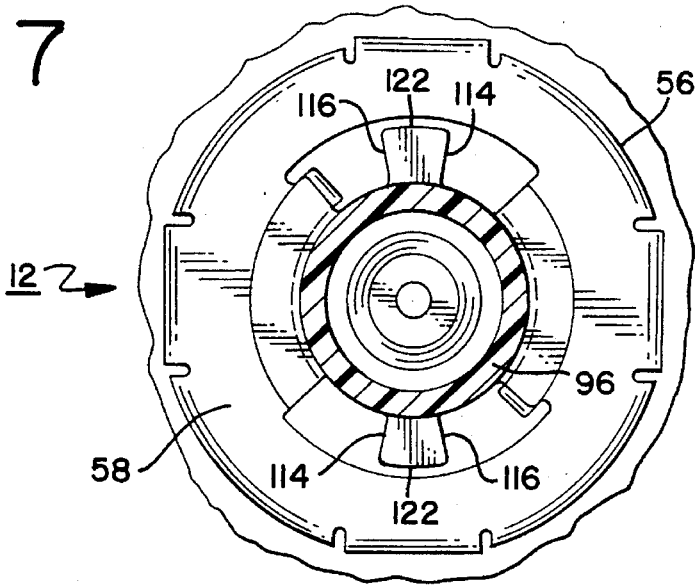
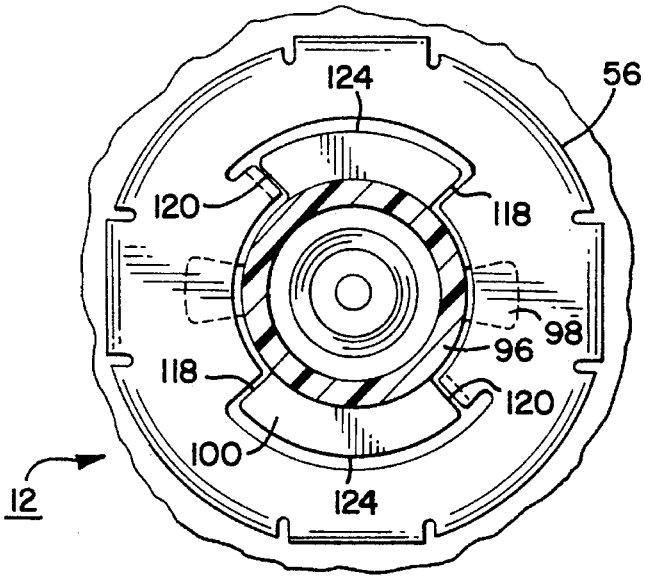
FIG. 8
FIG. 9
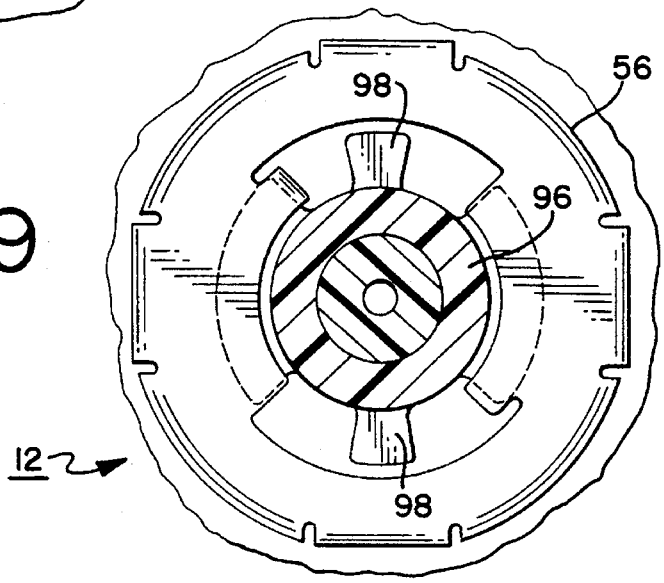

ATTACHMENT SYSTEM FOR FLUENT PRODUCT DISPENSERS

BACKGROUND OF THE INVENTION

The present invention relates generally to a dispensing apparatus, and more particularly, to an apparatus to facilitate attachment of an operator-controlled dispensing gun to a pressurized container for fluent products.

In recent years, significant advances have been made in packaging fluent products used for a variety of purposes, particularly those in the field of construction and repair. For example, "aerosol" or other pressurized containers for adhesives, caulking materials, insulating foams, and similar products have become increasingly common.

The convenience and other advantages of aerosol or other pressurized containers can be significant in many applications. Thus, while manually operated caulking guns are well known and generally satisfactory, a certain amount of skill is required to achieve a uniform dispensing rate. Caulking contained in tubes and dispensed by ratchet-operated trigger mechanisms inherently require repositioning the trigger after a certain volume has been dispensed, leading to uneven and irregular dispensing.

Coordinating the movement rates of a trigger or other device with the rate of moving the container during product application often requires more concentration and coordination than an occasional user, such as a hobbyist, is able to muster, with the result that the visual or functional effect of the product being dispensed is compromised. If the product being dispensed is one whose appearance will be highly visible, uniformity of dispensing may be an important consideration. Where structural strength or integrity is important, such as with adhesives or sealants, uniformity and/or sufficiency of dispensing can be critical.

Very recently, improved dispensing guns have been developed whereby the bead size of a fluent product such as a caulk, adhesive, or insulating foam material (either "expanding" or "non-expanding") can be carefully controlled and flow can be shut off at the tip of the gun rather than inside the valve, thereby minimizing so-called "drooling" or flow after the valve is shut off. Such guns, including those referred to in my pending patent application Ser. No. 08/264,641 filed Jun. 23, 1994 have proven successful in achieving a degree of control that is not achievable with ordinary aerosol or similar pressurized containers.

However, guns of this and other types which are adapted to be used with a single, moderate size can, i.e., 12 to 24 ounces, for example, although not expensive in some respects, are most economically utilized when the user intends to dispense several containers of product in connection with a single project. Guns of the above-referenced type that possess a handle and a trigger separate from one which may merely be positioned atop the valve of an aerosol unit, require attachment systems that have cooperating counterparts on the aerosol cans.

Thus, where it is known that containers of dispensable product are to be used with a special-purpose gun, then the container and the gun may have preformed mating parts to facilitate proper attachment and sealing of the gun and the container. While this is convenient, safe, and effective in use, it does have the drawbacks of requiring a particular container to be dedicated to use with the gun. This in turn can create undesirable problems of inventory control, particularly with resellers who do not wish to stock redundant inventory, i.e., inventory wherein two essentially identical products must be treated as different from each other. Manufacturers do not prefer to make two different style packages of substantially identical product, particularly where the intended application for both styles of containers is the same.

Accordingly, it would be desirable if a simple and inexpensive adapter system could be made for existing pressurized containers whereby the choice could be made by the packager, the retailer or the customer to provide a dispensing valve in association with the can itself or to render the can useful with a special purpose gun, and do so in a highly effective, very inexpensive manner. It would also be advantageous if such an adapter system could be made to incorporate a low risk form of operation, i.e., one which reduces the chance of misalignment, accidental leakage, or unintended discharge of the container contents during gun attachment.

It would also be desirable if an attachment system of a simple kind could be made for dispensing containers, particularly where such system could be made at low cost. An ideal attachment system would be one wherein the attaching ring or the like could be made in a simple manner for compatibility with various existing valve systems and/or gun attachment systems such as bayonet locks, wedge type units or threaded style valve actuators.

Likewise, it would be further advantageous if an adapter system could be provided wherein the user or the retailer could either add a simple low cost component to existing cans or, in the alternative, could remove such an adapter if it were pre-fitted to the container but not desired for use, all without risk or the involvement of measurable technical or mechanical skill.

In view of the failure of the prior art to provide the highly effective, low cost adapter or attachment systems permitting dispensing guns to be used with low cost containers of fluent materials, it is an object of the invention to provide an improved system for this purpose.

Another object of the invention is to provide a twist lock system for dispensing containers wherein the system includes a specially designed locking ring that is readily affixable to the valve assembly of a low cost aerosol container, using a dual plane or other arrangement of cooperating locking lugs on an associated gun.

Still another object of the invention is to provide a twist lock type adapter for converting an aerosol can with a manually actuable valve to a can that can be securely locked to a separate, trigger-operated dispensing gun.

A further object of the invention is to provide a dispensing gun having a combination twist lock and valve actuating system including one or more pairs of locking lugs positioned in an offset, dual plane arrangement so as to avoid accidental actuation of the can dispensing valve.

Yet another object of the invention is to provide an attachment and valve actuating system wherein a ring style adapter can be used that is compatible with various inclined plane or ramp-type actuators, coarse thread mechanisms or other similar simple attachment systems.

A still further object of the invention is to develop a dispensing gun having a safety-type twist lock and a valve capturing an actuating system forming a part of its product inlet, whereby the container valve cannot be actuated unless the container and gun are properly positioned relative to each other. Yet another object of the invention is to provide a locking ring adapter for an aerosol can which ring may be readily detachable by the user but that resists accidental release from the can when in use on the product.

A further object of the invention is to provide an improved combination twist lock and gun positioning assembly including a dispensing gun with a pair of locking lugs spaced both circumferentially and axially apart or in a dual plane arrangement to insure positive positioning during the engaging/positioning and locking operations.

Another object of the invention is to provide a gun positioner of the type just described wherein the components are made of low cost material, such as a metal locking ring and a plastic locking lug assembly.

A still further object of the invention is to provide an adapter or attachment system which is useful with a variety of valves, including so-called Clayton valves, VCA valves, or other styles of valves including spring loaded valves, tilt action valves or the like.

The foregoing and other objects and advantages of the invention are achieved in practice by providing a twist lock system for a dispensing container which includes a locking ring for a pressurized container, a dispensing gun having a combination twist lock and valve actuating system including two pairs of radially and circumferentially spaced locking lugs cooperating with slots and the locking ring, an axially movable valve stem positioned in a body secured to the container end and a valve capturing and actuating surface formed on the dispenser gun, with the components constructed and arranged so that the valve cannot be actuated unless the container and gun are properly positioned.

The exact manner in which the foregoing and other objects and advantages of the invention are achieved in practice will become more clearly apparent when reference is made to the accompanying detailed description of the preferred embodiment of the invention set forth by way of example and shown in the accompanying drawings in which like reference numbers indicate corresponding parts throughout.

BRIEF DESCRIPTION OF THE DRAWINGS

FIG. 1 is an exploded perspective view of portions of the dispensing gun, the locking ring, and a portion of the valve container of the invention, showing relation of these components to one another;

FIG. 2 is a plan view of the locking ring of the invention, taken along lines 2—2 of FIG. 1 and showing the spaced apart ears, flanges and notches arranged to position the gun locking lugs;

FIG. 2A is a vertical sectional view of the locking ring of FIG. 2, taken along lines 2A—2A thereof and showing how the ring is released from the container when desired;

FIG. 3 is a bottom plan view, taken along lines 3—3 of FIG. 1 and showing the dual plane locking lugs of the dispensing gun;

FIGS. 7–9 are sectional views showing the sequence of capture and actuation occurring as the gun is positioned and locked relative to the container;

DESCRIPTION OF THE PREFERRED EMBODIMENTS OF THE INVENTION

Figure 4:
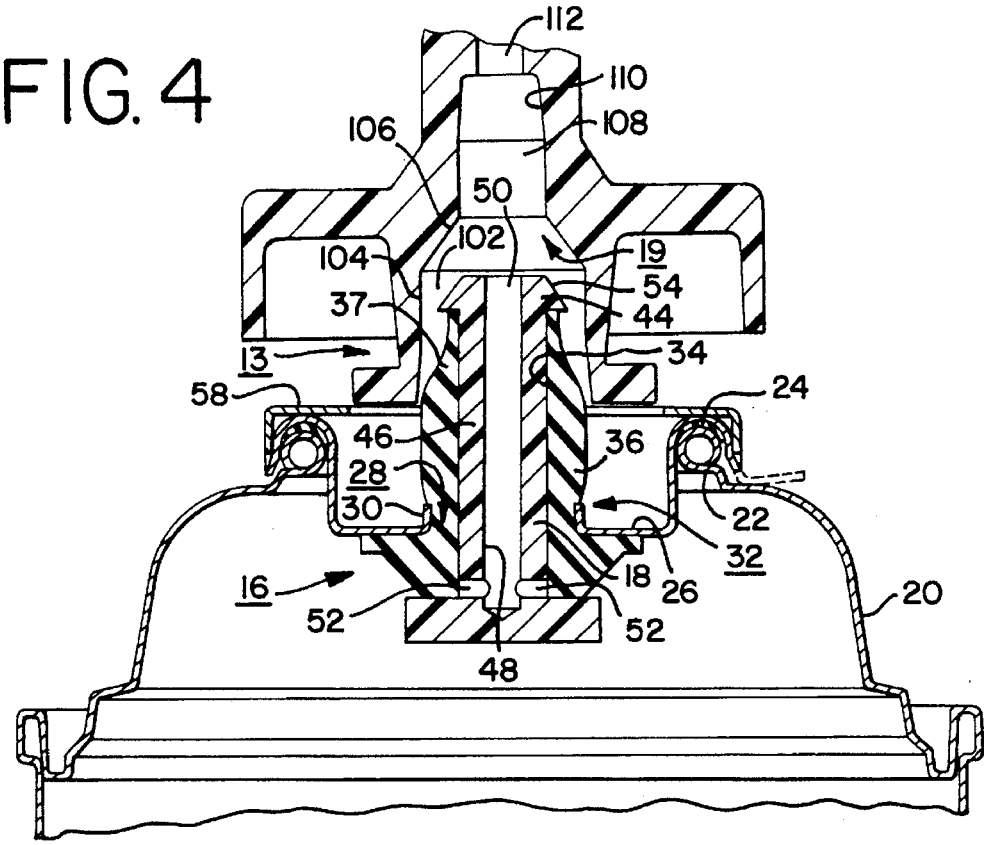
FIG. 4 is a vertical sectional view of the locking adapter ring, showing the positioning and locking flange including the bead engaging claws and teeth on the flanges, and also showing the gun just before initial position.

While the advantages of the invention may be achieved by a somewhat varied arrangement and configuration of parts, a description of one presently preferred form of invention will be given wherein the product container is a pressurized aerosol can with an axially actuable dispensing valve for a fluent product; the locking ring adapter is a metal ring that is detachable from the container, and wherein the gun includes a dual plane arrangement of locking lugs cooperating with the locking ring.

Referring now to the drawings in greater detail, the invention can be seen to be embodied in a two-step twist lock and valve actuation arrangement generally designated 10. The combination includes a container generally designated 11 for fluent products, a detachable locking ring generally designated 12 and serving as a mounting adapter; and the attachment portion generally designated 13 of a dispensing gun generally designated 14.

According to the invention, the product container 11 includes (FIGS. 4–6) a centrally disposed container valve assembly generally designated 16, the stem portion generally designated 18 of which will be actuated by capturing and actuating surfaces 19 (described in detail elsewhere herein) on the gun 14.

Figure 5:
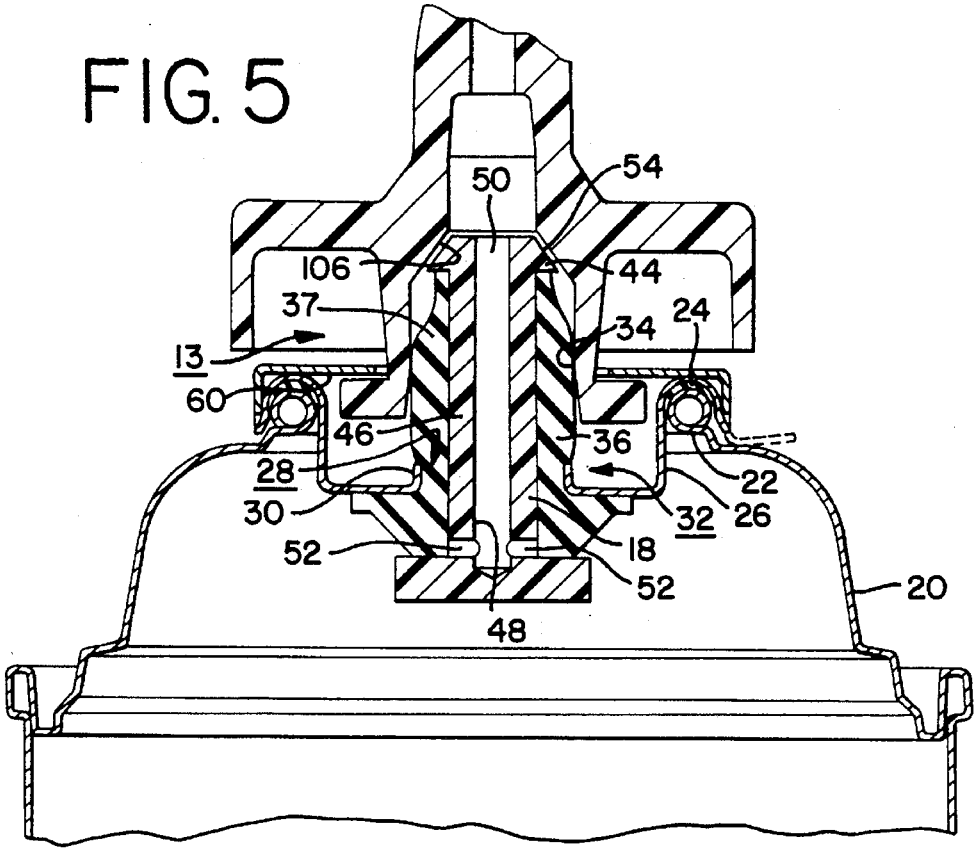
FIG. 5 is a view similar to that of FIG. 4, and showing the gun in the initial position of registration relative to the locking ring.
Figure 6:
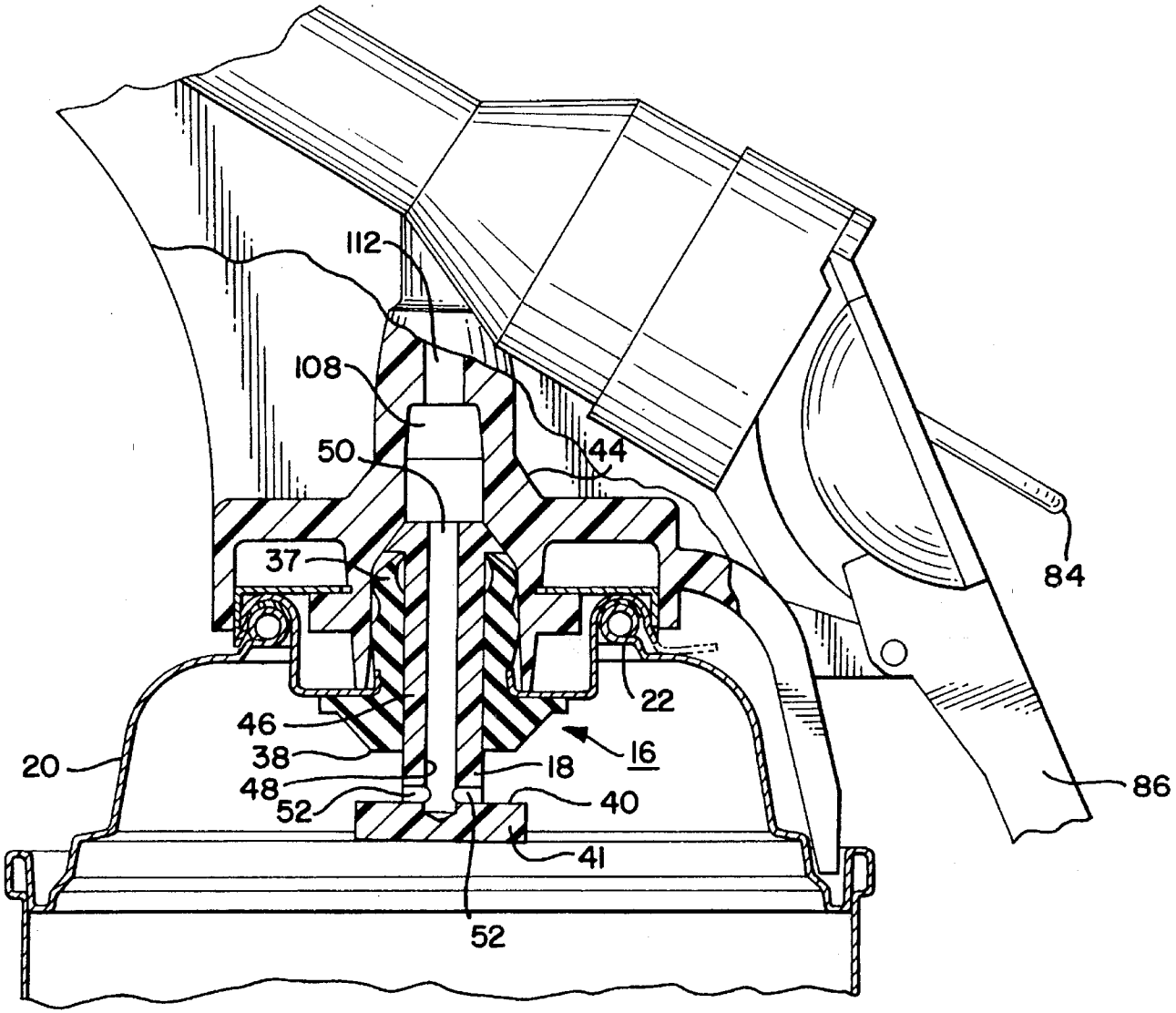
FIG. 6 is a view similar to that of FIGS. 4 and 5, and showing the gun in its final position of registration with the valve stem in the actuated position and also showing more details of the gun trigger.

Referring now to FIGS. 4–6, it is shown that the container generally designated 11 includes a top dome generally designated 20 and having a rolled top bead portion 22 to which is snugly affixed a curled margin 24 of a valve carrier cup 26. The carrier cup 26 includes a center opening generally designated 28 formed in the cup 26 by an upturned marginal flange 30. The flange 30 serves to locate a somewhat flexible, preferably elastomeric, valve body generally designated 32. The valve body 32 includes a cylindrical center passage 34 defined by an exterior sidewall 36 that has a more flexible upper portion 37 and terminates at its lower end in an enlarged diameter valve stem seating shoulder 38 (FIG. 6). By "lower" and like expressions is meant lower when the container is positioned with the valve on top.

In use, the stem seating shoulder 38 engages the annular end face 40 on the seating disc 41 of the hollow center valve stem 18, such seating arrangement providing fluid-tight sealing. The stem 18 includes a head portion 44 and a cylindrical sidewall 46 defining a center passage 48. The passage 48 has an open outlet 50 at its upper end and radial inlet ports 52 near its lower end just above the seating disc 41. The valve stem head 44 has a tapered shoulder surface 54 (FIG. 4) for cooperating with the attachment portion 13 of the gun 14.

As is known to those skilled in the art, when the valve stem 18 is pushed downwardly by forces acting on the tapered shoulder 54 of the stem head 44, the upper sidewall portion 37 bulges outwardly (FIG. 6) and the seating surfaces 38, 40 are moved out of an engaging sealed relation. This allows pressurized fluid to pass through the radial ports 52 and through the hollow center passage 48 in the stem 18 to the outlet 50. From here, as will be described, the product will flow into the interior of the gun 14 for dispensing under control of the trigger.

Referring now to FIGS. 2 and 2A, details of the detachable locking ring generally designated 12 are shown. The ring includes a number of principal components including a circumferentially extending main ring 56 having opposed surfaces, an upper surface 58 and lower, bead-engaging surface 60 (FIG. 2A). Extending radially inwardly are a pair of lug-engaging ears 62, each having an arcuate inner surface 64 (FIG. 2) and a downturned lug stop 66. The ears 62 are circumferentially spaced apart by notches 68 permitting entry and withdrawal of locking lugs, as will be described.

On the outer diameter of the ring 12 are downwardly (axially) extending, alternating shallower flanges and deeper locating flanges 70, 72, with one of the deep flanges 72 including inwardly and upwardly extending claws 74 (FIG. 2A), and the opposite flange including a locking claw 76 and a pry-off tab 78. When the tab 78 is pried up, as by a screwdriver blade, the ring 12 will snap off the end of the can, as illustrated in the phantom lines of FIG. 2A.

Referring now to other elements of the attachment system, FIGS. 1 and 4–6 show that the gun 14 includes a number of conventional elements including a barrel 80, a metering chamber 82, and a ring 84 affixed to an extension on the end of the metering rod. Such a ring permits the metering rod to be rotated if the composition is an adhesive or foam that has cured or "set up" and locked the dispensing or valving rod to the inside diameter of the barrel. In addition, a trigger 86 is attached as at pivot 88 to the cover plate 90 of the gun 14. The container cover 90 includes a circumferential skirt portion 92 and a trigger support flange 94. A generally cylindrical sidewall 96 supports first and second offset pairs of locating and locking lugs 98, 100.

As shown in FIG. 4, the cylindrical wall 96 includes an enlarged diameter lower product passage 102 formed by cylindrical sidewall 104, a tapered shoulder surface 106, a transfer passage 108 defined by a sidewall 110 and an uppermost passage 112 directed to a chamber (not shown) from which the fluent product is dispensed by manipulating the trigger 86.

Referring now to the pairs of locating lugs 98, 100, the first pair are a lowermost or axially outer set, and are relatively narrow, with their leading and trailing edges 114, 116 being relatively closely spaced apart. The second pair of lugs 100 is an inner pair with each lug having a leading and trailing edge 118, 120 spaced somewhat farther apart to provide added width. The outer arcuate surfaces 122, 124 of the lugs 98, 100 are sized so as to be closely spaced inwardly from the surfaces 126 (FIG. 2) defining the notches 68 in the adapter ring 12.

Referring now to FIGS. 4–6, steps in the operation of the attachment device and the container dispensing valve are illustrated. In FIG. 4, with the attachment portion 13 of the gun 14 being positioned such that the first pair of lugs 98 is just above the upper surface 58 of the attaching ring 12, the container valve 16 is closed and the beveled surface 54 forming a top part of the valve stem 18 is spaced well apart from the beveled valve capturing and activating surface 106 on the gun attachment portion 13.

FIG. 5 shows the first stage of downward movement of the attachment portion 13. Here, the first set of lugs 98 has passed through the notches 68 and the lugs 98 are positioned beneath the lower surfaces 60 of the ring 12. The stem and valve capturing surfaces 54, 106 are in light contact or are spaced very closely apart from each other. In this initial position, the upper set of lugs 100 are positioned in an out-of-registry position relative to the notches 68 on the locking ring 12, and accordingly, the attachment portion 13 of the dispensing gun cannot be pushed lower than the position of FIG. 5.

Only when the gun is rotated fully from the position of FIG. 5, i.e., until the leading edges 114 of the lugs 98 engage the lug stop 66 do the notches 68 register with the upper lugs 100. At this point, there is vertical alignment between the various passages 108, 112 in the attachment portion 13 of the gun 14 and the center passage 48 of the valve stem 18. At this point, the attachment portion 13 may be pushed lower, permitting the first pair of lugs 98 to clear the lug stops 66. The combination of lowering the first set of lug stops 98 beneath the level of the lug stops 66 and a twisting motion permits the upper or second pair of lugs 100 to pass beneath or in contact with the lower surfaces 60 of the ears 62, which prevents upward lug movement.

The downward movement of the dispenser gun, and in particular, the attachment portion 13, causes the abutting tapered surfaces 106, 54 to maintain a centered relation of the valve stem and to lower the valve stem to the position of FIG. 6. This causes a bulging of the upper portion 37 of the valve body sidewalls 36, but maintains a seal between the valve stem and the valve body. The lower disc 41 of the valve stem is unseated such that the opposing surfaces 38, 40 no longer form a seal. This exposes the passages 52 to flow of material in the interior of the container 11 to pass through the passages 48, 108, 112 and into the gun metering chamber 82.

At this point, the lugs are positioned and there is a snug mechanical relation between the various portions of the gun 14 and the container 11, including contact between the skirt 92 and the flange 70 of the locking ring 12. An upward biasing force is maintained by the flexible but deformable upper sidewall portion 37 of the valve body 36 to insure against gun movement relative to the container and to provide a fluid-tight seal.

After the valve stem is pushed downwardly and the contents are urged toward the dispensing chamber of the gun, the gun can be manipulated by its trigger only, and the container valve no longer functions to control product flow. However, if it is desired to remove the gun for any reason, the attachment steps are repeated in reverse order and the valve will close before the gun is removed from the container.

Referring to the snap-on attaching ring, as pointed out, this may be attached by a simple press-on operation by the can filler, the retailer, or the consumer. If the attaching ring is not to be used, it may be removed by manipulating a screwdriver blade as referred to above and discarded or retained for later use.

As pointed out, the advantages of this arrangement are that the can adapter ring is simple but reliable and can be manufactured at very low cost. It may be retained or discarded without significant economic impact. By utilizing the separate gun, which may be used with a plurality of containers, careful control over dispensing rate may be achieved. The containers thus need not include a more controllable and more expensive dispensing valve or a trigger arrangement if they are sold for this application.

While there is some latitude in selection of materials, it has proven advantageous to have the locking ring made from a spring steel material of 0.025" thickness, for example. The locking lugs and the remainder of the attachment portion 13 of the gun 14 may be made from a suitably hard engineering plastic that is not unduly brittle. The valve body is preferably made from a synthetic elastomer and the valve stem from polyethylene.

Figure 10:
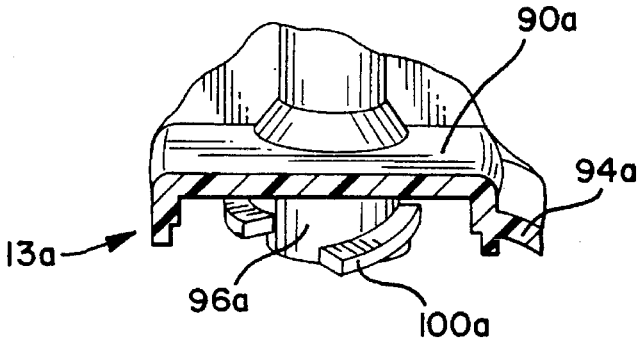
FIG. 10 is a perspective view of a modified part of the gun mounting mechanism.
Figure 11:
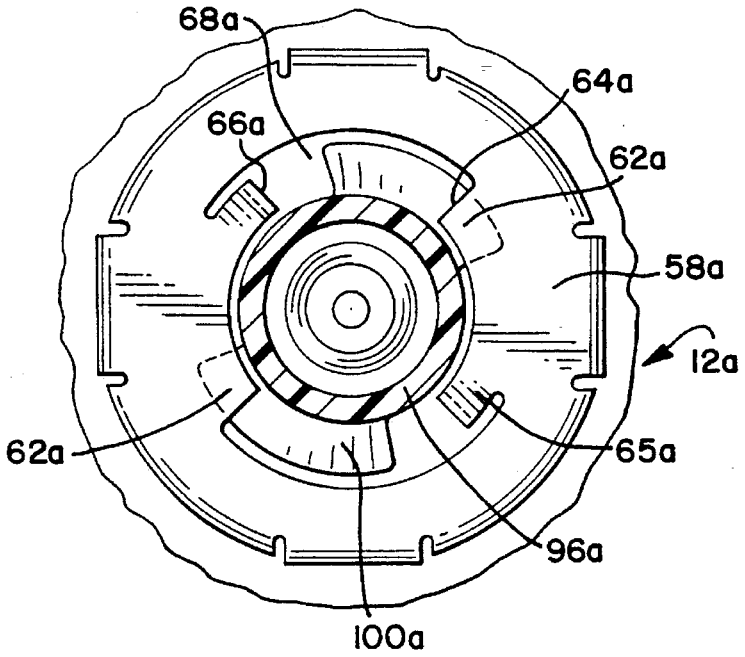
FIG. 11 is a top plan view of a locking ring adapted for use with the gun of FIG. 10.

Referring now to FIGS. 10 and 11, another embodiment of the invention is shown. Here, the attachment portion generally designated 13*a* of the dispensing gun is similar to that in the earlier embodiment and includes a cover plate 90*a*, a trigger support portion 94*a* and other parts resembling its counterpart in FIG. 1. On the lower cylindrical sidewall 96*a*, the interior of which engages the container valve, is a different arrangement of locking lugs 100*a*. Here, there are shown two locking lugs each subtending an angle of about 90° and each being in the form of an inclined ramp. When this form of lock is used with a locking ring and mounting adapter 12*a* of the type shown in FIG. 11, and the sidewall 96*a* is positioned as indicated, the operation of the locking mechanism can readily be determined.

On the ring 12*a*, lug engaging ears 62*a* are provided and each may optionally include a lug stop 66*a*. The ears may be more inclined from the plane of the surface 58*a* than their counterparts in FIG. 2, so as to match the inclined surfaces on the ramp lugs 100*a*. Between the ears 62*a* are notches 68*a* to permit initial entry of the lugs 100*a*. Hence, the edge surfaces 64*a* of the ears may be slightly raised above the plane of the upper surface 58 of the ring 12*a* while the nose portion 65*a* is lowered slightly beneath the plane of the surface 58. In this instance, when the ends of the lugs 100*a* engage the lug stops 66*a*, because of the shallow angles of the lugs and ears, the gun is tightly locked to the container.

Figure 12:
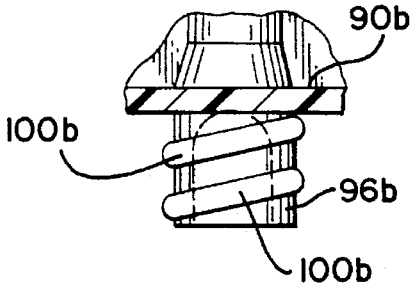
FIG. 12 is a side view, partly in elevation and partly in section, showing still another form of gun mounting mechanism.

Referring now to FIG. 12, a similar but modified construction of locking mechanism is shown, in that the cover plate 90*b* and the sidewall 96*b* are similar, but instead of spaced apart lugs, coarse screw threads 100*b* are provided for engagement with a locking ring similar to that of 12*a*. Other twist lock arrangements will occur to those skilled in the art and may be made, including arrangements wherein portions of the lugs strike the bottom of the container cup 26 to create a positive stop effect.

A significant aspect of the later-described locking systems is that the lugs have a shallow ramp angle to ensure that the force of the valve will not permit the lugs to be unintentionally backed out of their twisted-on relation relative to the locking ring. In other respects, including the ease of attachment and detachment using a screwdriver blade or the like, the attaching ring 12*a* is the same as its counterpart 12 in FIG. 1, for example. Of course, minor variations may be made for purposes of creating a cooperating relation between the ring and the lugs on the sidewalls of the container attachment. Thus, for example, several leads or openings may be provided if a multi-lead screw arrangement is desired for some reason.

It will thus be seen that the present invention provides an improved attachment system for fluent product dispensers having a number of advantages and characteristics including those pointed out and others which are inherent in the invention.

I claim:

1. In combination, a valved dispensing container, an adapter ring, and a trigger-operated dispensing gun, said valved container including a valve assembly received within a mounting cup, said cup having an outer margin attached at a cup seam to a top portion of said container, a valve body and a valve stem movable within said valve body between open and closed positions, said valve stem having a product outlet passage and an upper contact surface surrounding said passage, an adapter ring made from a stiff, tough and flexible material and removably affixed to said container, said ring including generally axially extending ring locating flanges, an outer end face including circumferentially spaced apart locking ears separated by notches, and locking claws on at least two of said ring locating flanges, said claws being releasably engageable with said cup seam, with at least one of said ears including a lug stop extending axially inwardly from an end of said ear, said dispensing gun including an attachment portion with a container-engaging skirt, a valve stem capturing and operating portion and two axially spaced apart pairs of locking lugs, said valve stem operating portion including a contoured surface for fluid-tight engagement with said upper contact surface on said stem, and a center passage aligned with said valve stem product outlet passage, with said lugs in each of said lug pairs being also circumferentially spaced apart, one of said lugs having a leading edge engageable with said at least one lug stop, whereby, upon positioning said first pair of lugs beneath said ears on said locking ring and rotating said lugs to a stop-engaging position, said valve operating portion and said valve stem upper contact surface are in registry with each other and whereby further moving said gun axially and rotating said gun serves to permit engagement of said second lug pair with said ears and operates said valve by moving said stem to said open position, said lug leading edge engaging said lug stop to prevent further relative rotation of said container and to support said can and gun in a position for discharging the container contents by manipulation of said gun trigger.

2. A combination as defined in claim 1 wherein said ring is made from spring steel.

3. A combination as defined in claim 1 wherein at least one of said claw-containing flanges on said ring includes a tab for engagement by a ring release tool.

4. A combination as defined in claim 1 wherein said axially outer set of locking lugs is of a lesser circumferential extent than said axially inner set of lugs.

5. In combination, a valved dispensing container, an adapter ring, and a trigger-operated dispensing gun, said valved container including a valve assembly comprising a valve carrier cup attached to said container by a curled seam, a valve body carried by said cup and a valve stem movable within said valve body between open and closed positions, said valve stem having a product outlet passage and an exterior surface surrounding said passage and engageable with a passage-defining surface on said dispensing gun, an adapter ring made from a stiff but resilient material and removably affixed to said container, said ring including a plurality of generally axially extending locating flanges, an outer end face including circumferentially spaced apart locking formations separated by entry notches, with at least two of said locating flanges each including a locking claw for engaging said curled seam, and with said dispensing gun including a container attachment portion having surfaces defining a product flow passage, said surfaces having portions engageable with said valve stem, said gun attachment portion also including plural cooperating elements for engaging said locking formations on said adapter ring, whereby, upon positioning said cooperating elements on said dispensing gun and said formation on said locking ring in registry with one another, said valve stem is actuated and said gun may dispense said product under the control of said gun trigger.

6. A combination as defined in claim 5 wherein said valve stem is axially movable.

7. A combination as defined in claim 5 wherein said adapter ring is made from spring steel.

8. A combination as defined in claim 7 wherein one of said clawed locating flanges on said adapter ring further includes a release tab for engagement with a hand tool.

9. A combination as defined in claim 5 wherein said cooperating elements are locking lugs and said locking formations are locking ears on said ring.

10. A combination as defined in claim 9 wherein at least one of said locking ears includes a lug stop.

11. A combination as defined in claim 5 wherein said cooperating elements are screw threads and wherein said locking formations are spaced apart, inclined ramps for engagement with said threads.

12. A combination as defined in claim 5 wherein said cooperating elements are inclined ramps and said locking formations are ears inclined relative to the plane of said curled seam.

* * * * *